US006578743B1

(12) United States Patent
Kokeisl

(10) Patent No.: US 6,578,743 B1
(45) Date of Patent: Jun. 17, 2003

(54) DOSING DEVICE FOR BULK GOODS

(75) Inventor: Theodor Kokeisl, Oberentfelden (CH)

(73) Assignee: Legno AG, Aarau (CH)

( * ) Notice: Subject to any disclaimer, the term of this patent is extended or adjusted under 35 U.S.C. 154(b) by 0 days.

(21) Appl. No.: 09/869,797

(22) PCT Filed: Dec. 27, 1999

(86) PCT No.: PCT/CH99/00630

§ 371 (c)(1),
(2), (4) Date: Jul. 5, 2001

(87) PCT Pub. No.: WO00/40484

PCT Pub. Date: Jul. 13, 2000

(30) Foreign Application Priority Data

Jan. 7, 1999 (CH) ..... 21/99
Dec. 16, 1999 (CH) ..... 2311/99

(51) Int. Cl.[7] ..... B65D 47/00

(52) U.S. Cl. ..... 222/506; 222/503; 222/545; 222/342; 294/68.24; 366/196

(58) Field of Search ..... 222/503, 506, 222/545, 342; 294/68.24; 366/184, 192, 196, 194, 195, 341; 105/247

(56) References Cited

U.S. PATENT DOCUMENTS 2,785,840 A 3/1957 Nave
3,396,675 A * 8/1968 Stevens ..... 105/280
3,845,886 A * 11/1974 Kokeisl ..... 222/241
4,043,491 A * 8/1977 Johnson et al. ..... 222/503
4,262,825 A * 4/1981 Jacobson et al. ..... 222/146.2
4,844,292 A 7/1989 Lonardi et al.
5,277,337 A * 1/1994 Ford et al. ..... 222/135
5,702,183 A * 12/1997 Rasimus et al. ..... 222/410
6,261,043 B1 * 7/2001 Weems et al. ..... 294/68.22

FOREIGN PATENT DOCUMENTS

| | | |
|---|---|---|
| CH | 426 640 | 6/1967 |
| CH | 529 679 | 10/1972 |
| DE | 44 04 315 | 9/1994 |
| EP | 327 966 | 10/1920 |
| EP | 0 270 870 | 6/1988 |

OTHER PUBLICATIONS

Patent Abstracts of Japan, vol. 009, No. 206 (M–406), Aug. 23, 1985.

* cited by examiner

*Primary Examiner*—Kevin Shaver
*Assistant Examiner*—Stephanie Willatt
(74) *Attorney, Agent, or Firm*—Wenderoth, Lind & Ponack, L.L.P.

(57) ABSTRACT

A dosing device including a hopper (1) having an outlet opening which is closed by two spherical cap halves (3, 4), which can be pivoted in opposite directions. The pivoting movement is effected by two arms (5, 6) pivoted about a common pivot pin (8). The spherical cap halves (3, 4) can be pivoted by a rod assembly (18, 19, 22, 23) including a vertically mobile plunger (14). To prevent the bulk goods bridging, a rotating loosening and scraping device (30) is provided, the base (31) of which reaches close to the outlet opening. With the dosing device, both large and small quantities of bulk goods can be discharged in accurate doses.

11 Claims, 3 Drawing Sheets

DOSING DEVICE FOR BULK GOODS

BACKGROUND OF THE INVENTION

Dosing devices for tapping bulk goods from a silo-like container are already known in which an outlet opening can be opened and closed by a slide valve moving along a straight line. Depending on the type of bulk goods, difficulties may arise due to the bulk goods tending to cake or adhere to the walls of the container, thereby preventing normal flow due to bridging. It appears that, on the one hand, even if the problem of irregular follow-up flow of the bulk goods may be lessened by having a larger outlet opening, the side gap opening created by the sliding movement along a straight line, on the other hand, is unfavorable when only small quantities are required.

In an efficient process for filling containers, sacks and the like with bulk goods, a quantity of goods must be discharged for rough dosing at a high rate within the shortest possible time. In the case of fine dosing or tare weight packing to an accurate weight, small quantities of bulk goods must be added or removed once or several times. This creates a problem due to the fact that both a large and small through-flow opening must be available. This requirement cannot be solved satisfactorily with conventional valve closures because, with the bulk goods unfavorably responding during their flow, the weight of the material column above the narrow side gap opening is supported by the conical wall of the hopper or adheres to it so that there is an increased tendency for the bulk goods to bridge when the bulk goods are discharged in only small doses.

SUMMARY OF THE INVENTION

The purpose of this invention is to improve a dosing device for bulk goods and make it suitable for discharging small quantities of such goods as well as discharging the goods at a high through-flow rate within a wide range when large quantities of goods are to be discharged within a short time while guaranteeing faultless follow-up flow of bulk goods even with such bulk goods tending to bridge.

Since the closure is designed in the form of two spherical cap halves, which can be pivoted towards each other, a large through-flow opening for bulk goods is obtainable when they are pivoted away from each other into the fully open position. Alternatively, small through-flow openings can also be made, positioned in the central drop area, that is at a vertical point above the vertical material column.

A further advantage, in comparison with the conventional slide valve closures, consists in the fact that a more compact construction can be achieved due to the absence of the sideways slide movement overhang. This allows space-saving mounting of a number of bulk goods containers next to each other.

It can be useful to provide a rotatable stirring and loosening device inside the hopper when bulk materials, which flow with difficulty, and which are known to have a greater tendency to bridging are handled. Such a stirring and loosening device together with an outlet valve moving in a straight line is described in DE 256 147. As distinct from this, the rotatable stirring and loosening device can in this present case extend to the central, lower area of the outlet opening of the spherical cap halves. This reliably counteracts bridging, in the case of bulk goods which flow with difficulty, down to the lowest area of the bulk goods containers, that is down to the spherical cap halves, and guarantees the follow-up flow of the goods even when only a small through-flow aperture is open.

A particularly compact layout facilitating maintenance work is achieved by designing the dosing device with a bearing ring attached at the bottom to a body and a swivel ring with a driving crane located in between.

BRIEF DESCRIPTION OF THE DRAWINGS

The drawing shows an example of design constructed in accordance with the present invention.

DETAILED DESCRIPTION OF THE INVENTION

Figure 1:
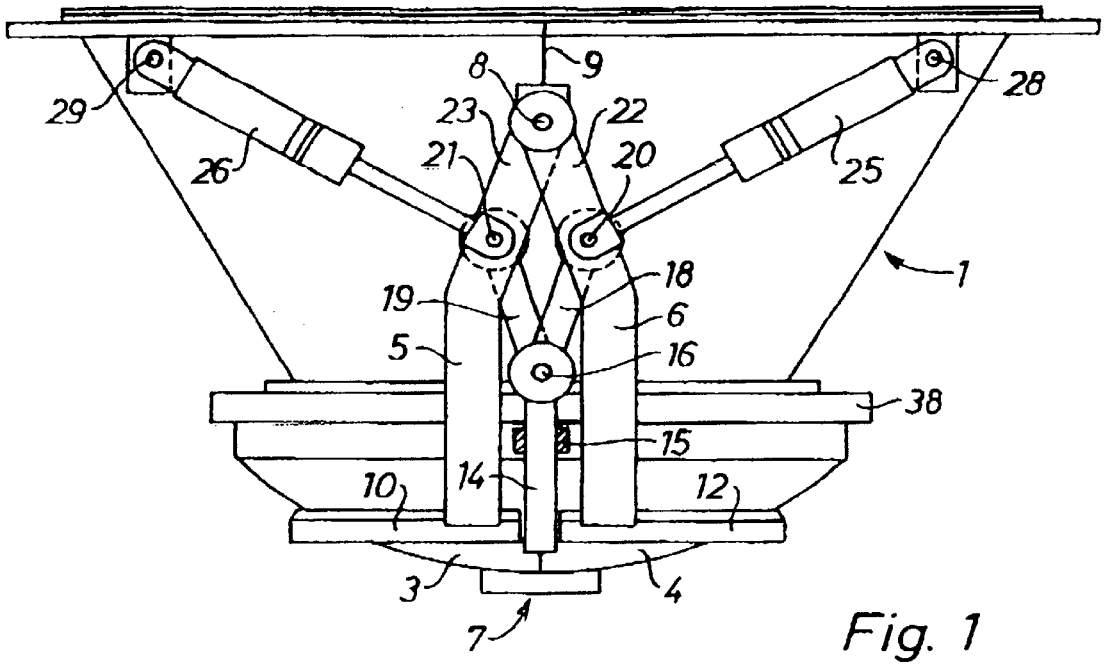
FIG. 1 is a side view of a view of a dosing device having spherical caps and parts for pivoting the spherical caps.
Figure 2:
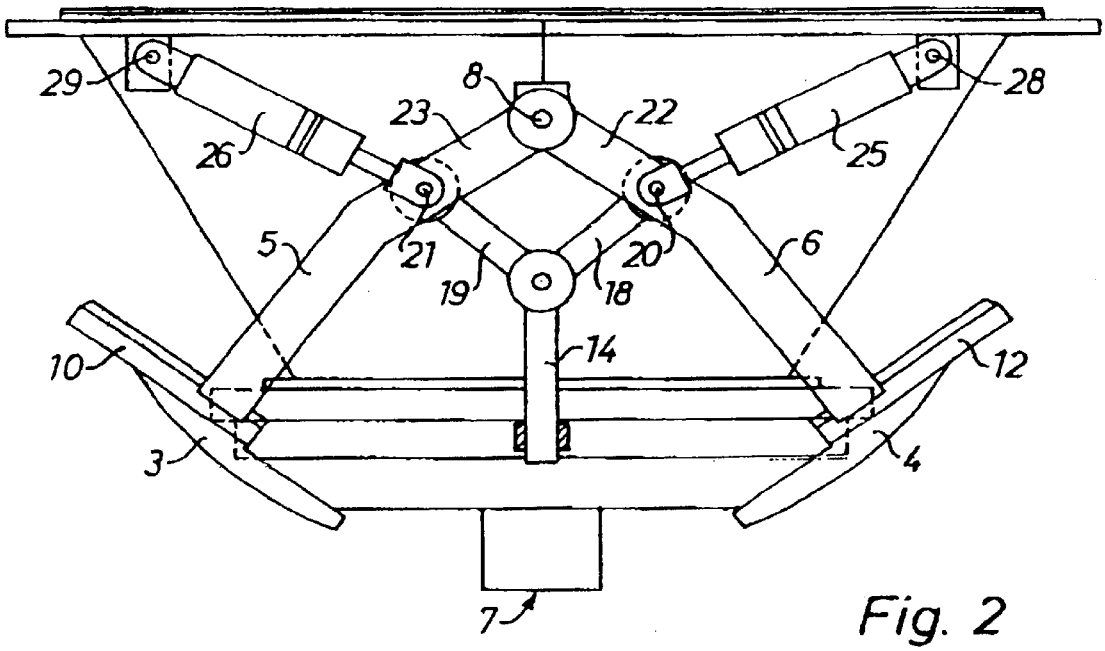
FIG. 2 is a side view with a part section through the dosing device shown in FIG. 1 with parts driving the loosening and scraping device.
Figure 3:
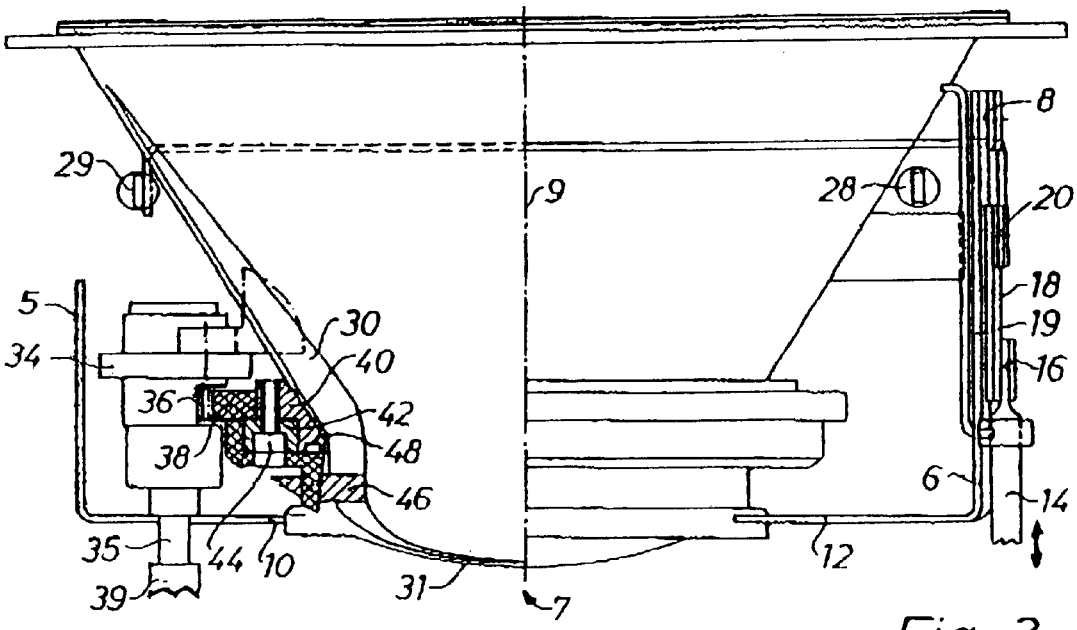
FIG. 3 is a side view through the dosing device with the loosening and scraping device.
Figure 4:
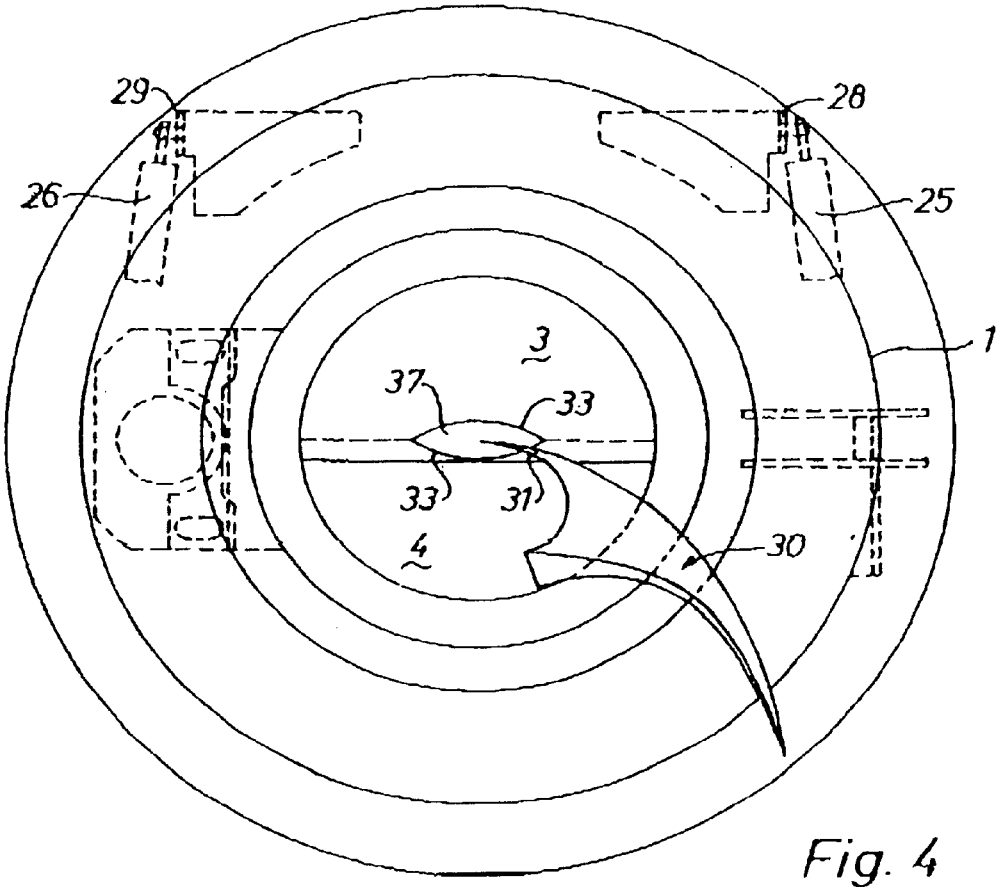
FIG. 4 is a plan view of the assembly shown in FIG. 3, in which the spherical cap halves are pivoted by a small amount to open a small through-flow aperture.

FIG. 1 shows a conical hopper 1 for bulk goods on top of which a conical or cylindrical silo-type container for bulk goods can be mounted. The hopper 1 for bulk goods is open on top and contains an outlet opening 7 at the bottom. When closed, this outlet opening is covered by two spherical cap halves 3, 4. Each of the two spherical cap halves 3, 4 is connected to an arm 5, 6 that is pivoted about a common pivot pin 8 located above the outlet opening. The center line of the pivot pin 8 intersects the center vertical line 9. The spherical cap halves are each connected firmly to the arms 5, 6 by means of angle brackets 10, 12.

The two arms 5, 6 and thus the spherical cap halves 3, 4 are moved together by means of an articulated linkage. A vertical plunger 14 is intended to act together with a detachable, vertically up and down moving device which is not shown here. The plunger 14 moves in a straight line in a bearing 15. Two rods 18, 19 are pivoting at the top end of this plunger 14 at a first bolt 16. These two pivoting rods 18, 19 each form an acute angle with the center vertical line 9 when the spherical cap halves 3, 4 are in the closed position. The rods 22, 23 are each pivoted at the top ends of the two rods 18, 19 at the second bolts 20, 21. The bolts 20, 21 pass through the arms 5, 6 and are connected to move together with them. These two rods 22, 23 are suspended at the pivot pin 8 at which the two arms 5, 6 also pivot.

A spring unit 25, 26 such as a gas spring or a mechanical thrust coil spring each engages at the second bolt 20, 21. These spring units 25, 26 are biased to force the spherical cap halves 3, 4 into their closed position. The spring units 25, 26 are each suspended at a pivot 28, 29 on the hopper 1. As the spherical cap halves 3, 4 open in response to upward movement of the plunger 14, the length of the spring units 25, 26 shortens and they act as accumulators in the closing direction.

When closed, the two spherical cap halves 3, 4 can either abut against each other whilst forming a plain joint or can preferably overlap. In the case of overlapping, the center area of both spherical cap halves can have a central, arched section 33 and be designed so that a small, hole-like through opening 37 forms first during the opening movement and gradually widens as the spherical cap halves 3, 4 are progressively swivelled away from each other. This also allows small quantities to be discharged.

A rotatable loosening and scraping device 30 is located within the hopper 1. This device is in the form of a long arm with a domed section and extends along the container wall tilted away from the axis of rotation. The lowest part 31 of this loosening and scraping unit 30, which can be made in a single part or in several parts, extends at the bottom up to the center of the goods outlet opening and is positioned directly above the spherical bowls. Thus, as the loosening and scraping unit 30 rotates, its top part sweeps over the hopper wall and its lowest part 31 loosens the bulk material directly in front of the central outlet opening so that no bridging of the bulk material can occur even with a small outlet opening 37. The loosening and scraping unit 30 is driven via a reduction gear unit 34 flanged at the container, its pinion engaging a ring gear 36 of a drive ring 38. This drive ring rests in a stationary annular guide ring 40 surrounding the container 1 on the outside. The drive ring 38 is held at the guide ring 40 by several sliding shoes 42 which are equally spaced on the periphery and attached by means of bolts 44. A radial shoulder 46 pointing inwards extends into the loosening and scraping device 30 and is driven as the drive ring 38 rotates. A ring seal 48 is fitted between the drive ring 38 and the guide ring 40. The drive ring 38, and preferably also the guide ring 40, are made of a plastic with good sliding properties.

The reduction gear unit 34 has at the bottom an extension 35 and a detachable coupling 39 intended for detachably connecting to the opposite half of a coupling at a preferably movable motor. In place of a gear 34, a motor drive shaft can also directly engage the ring gear 36.

In one version of design, the drive for opening and closing the spherical cap halves 3, 4 could be operated by means of a hand crank with a screw instead of a plunger.

Figure 5:
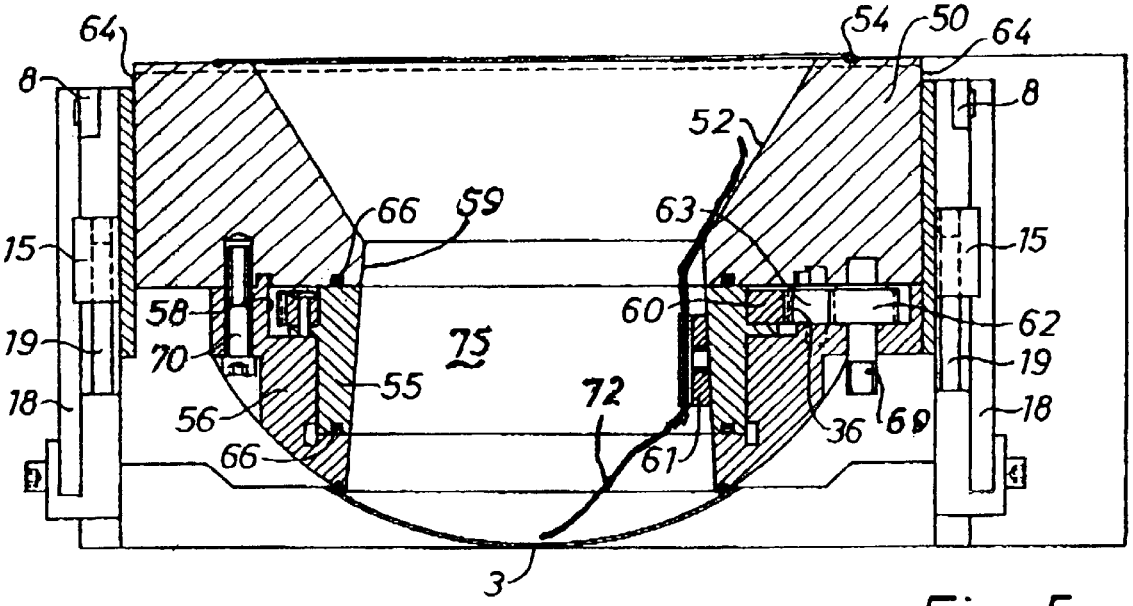
FIG. 5 is a section view through a version of the design.
Figure 6:
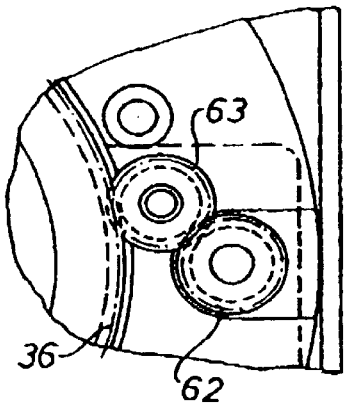
FIG. 6 is a detailed view of the drive pinion.

FIGS. 5 and 6 show a modified version of the dosing device. A housing type body 50 contains a hopper inner wall 52. This body 50 is designed as a massive, thick-wall body which can be made of metal or plastic.

The top edge 54 of the body 50 is designed for supporting a storage hopper. A cylindrical swivel ring 55 sits at the bottom edge of the body 50, its bore being cylindrical or slightly conical and connecting on top without a shoulder to a cylindrical bore part 59 of the body 50. This swivel ring 55, which is connected to the loosening and scraping unit 72, is rotatable in relation to the body. The swivel ring 55 is surrounded by a stationary bearing ring 56 on the outside. The bore of this bearing ring 56 has several shoulders, the lowest of which overlaps the swivel ring 55. The bearing ring 56 is immovably mounted on the body 50 by means of several bolts 70 spaced out on the periphery. The swivel ring 55 is thus held rotatably between the seals of the bearing ring 56 and the body 50. A drive ring 60, which is radially spaced from a bore part 58 of the bearing ring 56, is connected with the swivel ring 55 against rotation. The drive ring 60 contains a ring gear 36 which meshes with a side pinion 63 (FIG. 6). The latter meshes with a drive pinion 62 provided with a shaft 69 which can be coupled with a drive (not shown). In a different design version, the drive pinion 62 could also mesh with the ring gear 36 directly or a toothed belt could be placed around the ring gear 36.

The body 50 has two outside faces 64, which are parallel to each other, on which the actuating devices 18, 19 for moving the spherical cap halves rest on bearings 15. These actuating devices correspond to those described and illustrated in connection with FIGS. 1 to 4. The parts 50, 55, 56 and 60 can be made either of metal or plastic.

Rotating the drive shaft 69 shall thus cause the loosening and scraping device, extending up to the spherical cap halves, to rotate, thereby preventing bridging of the bulk goods when the spherical cap halves are opened. The loosening and scraping device, which is fitted removably in the attachment device 61, runs in the upper section parallel to the hopper wall 52 and extends below into the hole 75 and down to the central area of the spherical cap halves. In addition, the loosening and scraping device 72 is tilted backwards in the upper area in relation to the direction of rotation.

What is claimed is:

1. A dosing device comprising:

a hopper for receiving a supply of bulk goods, said hopper having a bottom outlet opening;

a pivot pin located above the bottom outlet opening;

a closure provided at the bottom outlet opening of said hopper, said closure comprising first and second spherical cap halves that are pivotally mounted to said hopper via said pivot pin;

an articulated linkage for moving said first and second spherical cap halves in order to open and close said bottom outlet opening of said hopper; and a rotatable loosening and scraping device disposed inside of said hopper, wherein a lowermost portion of said loosening and scraping device extends below the bottom outlet opening of said hopper and to a position adjacent a central portion of said closure.

2. A dosing device as claimed in claim 1, wherein said articulated linkage comprises:

a first arm having an upper end connected to said pivot pin, and a lower end connected to said first spherical cap half;

a second arm having an upper end connected to said pivot pin, and a lower end connected to said second spherical cap half; and a vertical plunger device connected to said first and second arms via first and second rods, respectively, wherein movement of said vertical plunger device causes said first and second arms to pivot toward and away from each other.

3. A dosing device as claimed in claim 2, further comprising first and second spring devices connected to said first and second arms, respectively, for biasing said first and second spherical cap halves into a closed position.

4. A dosing device as claimed in claim 3, wherein said first and second rods form an acute angle when said first and second spherical cap halves are in the closed position.

5. A dosing device as claimed in claim 2, further comprising a drive mechanism, disposed exteriorly of said hopper, for rotatably driving said loosening and scraping device about a central axis of said hopper.

6. A dosing device as claimed in claim 5, wherein said drive mechanism comprises a drive ring.

7. A dosing device as claimed in claim 5, wherein said loosening and scraping device is tilted backward relative to a direction of rotation of said loosening and scraping device, and is twisted in a longitudinal direction of said loosening and scraping device.

8. A dosing device as claimed in claim 2, wherein said hopper comprises a lower portion having a top edge adapted to receive a container thereon, a rotatable cylindrical swivel ring connected to said loosening and scraping device, and a drive ring engaged with said cylindrical swivel ring.

9. A dosing device as claimed in claim 8, wherein said hopper includes a conical wall portion, and said loosening and scraping device includes an upper portion which extends parallel to said conical wall portion and is inclined rearwardly relative to a direction of rotation of said drive ring.

10. A dosing device as claimed in claim 8, wherein said hopper further comprises a bearing ring supporting said cylindrical swivel ring, and a seal is provided between a surface of said bearing ring and a surface of said cylindrical swivel ring.

11. A dosing device as claimed in claim 6, wherein said drive ring includes a gear ring which is connected to at least one pinion.

* * * * *